US005823424A

United States Patent [19]

Allen

[11] Patent Number: 5,823,424

[45] Date of Patent: Oct. 20, 1998

[54] FOLDABLE BOX WITH INSERT

[75] Inventor: Jonathan W. Allen, Oyster Bay Cove, N.Y.

[73] Assignee: Wallace Packaging Corporation, Maspeth, N.Y.

[21] Appl. No.: 591,704

[22] Filed: Jan. 25, 1996

[51] Int. Cl.[6] ..... B65D 5/496

[52] U.S. Cl. ..... 229/120.07; 206/565; 220/527; 220/528; 229/120.33; 229/198

[58] Field of Search ..... 229/120.07, 120.33, 229/120.37, 120.38, 125.39, 136, 198, 190; 206/387.15, 561, 564, 565; 220/527, 528

[56] References Cited

U.S. PATENT DOCUMENTS

| | | | |
|---|---|---|---|
| Re. 26,742 | 12/1969 | Laskow | 229/136 |
| 778,711 | 12/1904 | Rundle | 229/120.33 |
| 1,126,246 | 1/1915 | Maier . | |
| 1,437,221 | 11/1922 | Borders . | |
| 1,469,622 | 10/1923 | Cole . | |
| 1,569,932 | 1/1926 | Hill | 229/190 |
| 1,667,354 | 4/1928 | Lupien . | |
| 2,032,373 | 3/1936 | Mellars et al. . | |
| 2,121,190 | 6/1938 | Fellowes . | |
| 2,200,320 | 5/1940 | Zalkind . | |
| 2,421,238 | 5/1947 | Borah | 229/198 |
| 2,784,895 | 3/1957 | Linwood, Jr. et al. . | |
| 2,791,366 | 5/1957 | Geisler . | |
| 3,306,521 | 2/1967 | Giacovas | 229/136 |
| 3,536,246 | 10/1970 | Rosen | 229/120.07 |
| 3,710,900 | 1/1973 | Fink | 229/561 |
| 3,752,385 | 8/1973 | Woodgate | 229/120.07 |
| 4,709,812 | 12/1987 | Kosterka . | |
| 4,801,079 | 1/1989 | Gonella . | |
| 4,895,252 | 1/1990 | Nomula et al. . | |
| 5,011,018 | 4/1991 | Keffeler | 229/528 |
| 5,168,991 | 12/1992 | Whitehead et al. . | |
| 5,238,112 | 8/1993 | Massey et al. | 229/387.15 |

FOREIGN PATENT DOCUMENTS

| | | | |
|---|---|---|---|
| 17825 | of 1905 | United Kingdom | 229/198 |
| 1316768 | 5/1973 | United Kingdom | 229/120.33 |

*Primary Examiner*—Gary E. Elkins
*Attorney, Agent, or Firm*—Darby & Darby

[57] ABSTRACT

A container includes a box comprising a bottom wall and four side walls. Each of the side walls is pivotably connected to the bottom wall. Each of the side walls has at least one bore that mates with at least one bore in an adjacent side wall when the box is folded into shape. An insert has a bottom wall and two side walls. Each of the insert side walls has at least one bore that mates with the at least one bore in the box side walls. A fastener extends through each of the mating bores in the box side walls and the insert bores to maintain the shape of the box and to maintain the position of the insert within the box. Another container includes a box comprising a bottom wall and four side walls. Each of the side walls is pivotably connected to the bottom wall. Two of the side walls each have a pair of flaps that are pivotably connected to the side wall on opposite edges. Each of the flaps has an inwardly facing surface and an outwardly facing surface. Each of the flaps has a piece of two sided tape adhered to either the outwardly facing surface or the inwardly facing surface so that the flaps are configured to be adhesively connected to an adjacent one of the other two side walls to maintain the shape of the box.

8 Claims, 4 Drawing Sheets

FOLDABLE BOX WITH INSERT

BACKGROUND OF THE INVENTION

1. Field of the Invention

The present invention relates to containers. More specifically, the present invention relates to foldable containers that can be manufactured and shipped in a flat, planar condition and can thereafter be folded into a box-like shape by the end user.

2. Discussion of the Related Art

A box that can be folded and fastened together by a suitable fastener is known, for example, from U.S. Pat. No. 1,469,622 to Cole. This patent discloses a box that can be folded and connected together by the use of staple-type fasteners. U.S. Pat. No. 1,667,354 to Lupien discloses a box that can be folded and assembled by the use of a plurality of fastener members. U.S. Pat. No. 4,801,079 to Gonella also teaches the use of a collapsible container that is connected together through the use of bosses 15.

Notwithstanding the foregoing foldable box type arrangements, there is still a need in the art to provide a foldable box that can be assembled together by a suitable fastener and which also includes an insert that is solely secured to the inside of the box by the same fastener that is used to form the shape of the box. The insert can be provided with inwardly directed projections to divide the inside of the container so that it may hold multiple objects. There is also a need in the art for a foldable box that can be assembled together through the use of two-sided tape.

It is, therefore, an object of the present invention to provide a container that secures an insert to the box by the same fastener that is used to form the shape of the box. It is a further object of the present invention to provide a container that can be shipped in a flat, planer shaped can thereafter be folded into a box-like shape by the end user simply through the use of two-sided tape. It is a still further object of the present invention to provide a container that requires less parts and, thus, is smaller and easier to manufacture. It is still a further object of the present invention that the container be simple and cost effective to manufacture, yet reliable and efficient in use.

SUMMARY OF THE INVENTION

In accordance with a preferred embodiment demonstrating further objects, features and advantages of the invention, a container includes a box comprising a bottom wall; four side walls, with each of the side walls being pivotably connected to the bottom wall. Each of the side walls has at least one bore that mates with at least one bore in an adjacent side wall when the box is folded into shape. An insert has a bottom wall and two side walls. Each of the insert side walls has at least one bore that mates with the at least one bore in one of the box side walls. A fastener extends through each of the mating bores in the box side walls and the insert bores to maintain the shape of the box and to maintain the position of the insert within the box.

In accordance with a further preferred embodiment demonstrating further objects, features and advantages of the invention, a container includes a box comprising a bottom wall and four side walls. Each of the side walls is pivotably connected to the bottom wall. Two of the side walls each have a pair of flaps that are pivotably connected to the side wall on opposite edges. Each of the flaps has an inwardly facing surface and an outwardly facing surface. Each of the flaps has a piece of two sided tape adhered to either the outwardly facing surface or the inwardly facing surface so that each one of the flaps are configured to be adhesively connected to an adjacent one of the other two side walls to maintain the shape of the box.

BRIEF DESCRIPTION OF THE DRAWINGS

The above and still further objects, features and advantages of the present invention will become apparent upon consideration of the following detailed description of a specific embodiment thereof, especially when taken in conjunction with the accompanying drawings wherein like reference numerals in the various figures are utilized to designate like components, and wherein.

DETAILED DESCRIPTION OF THE PREFERRED EMBODIMENT

Figure 1:
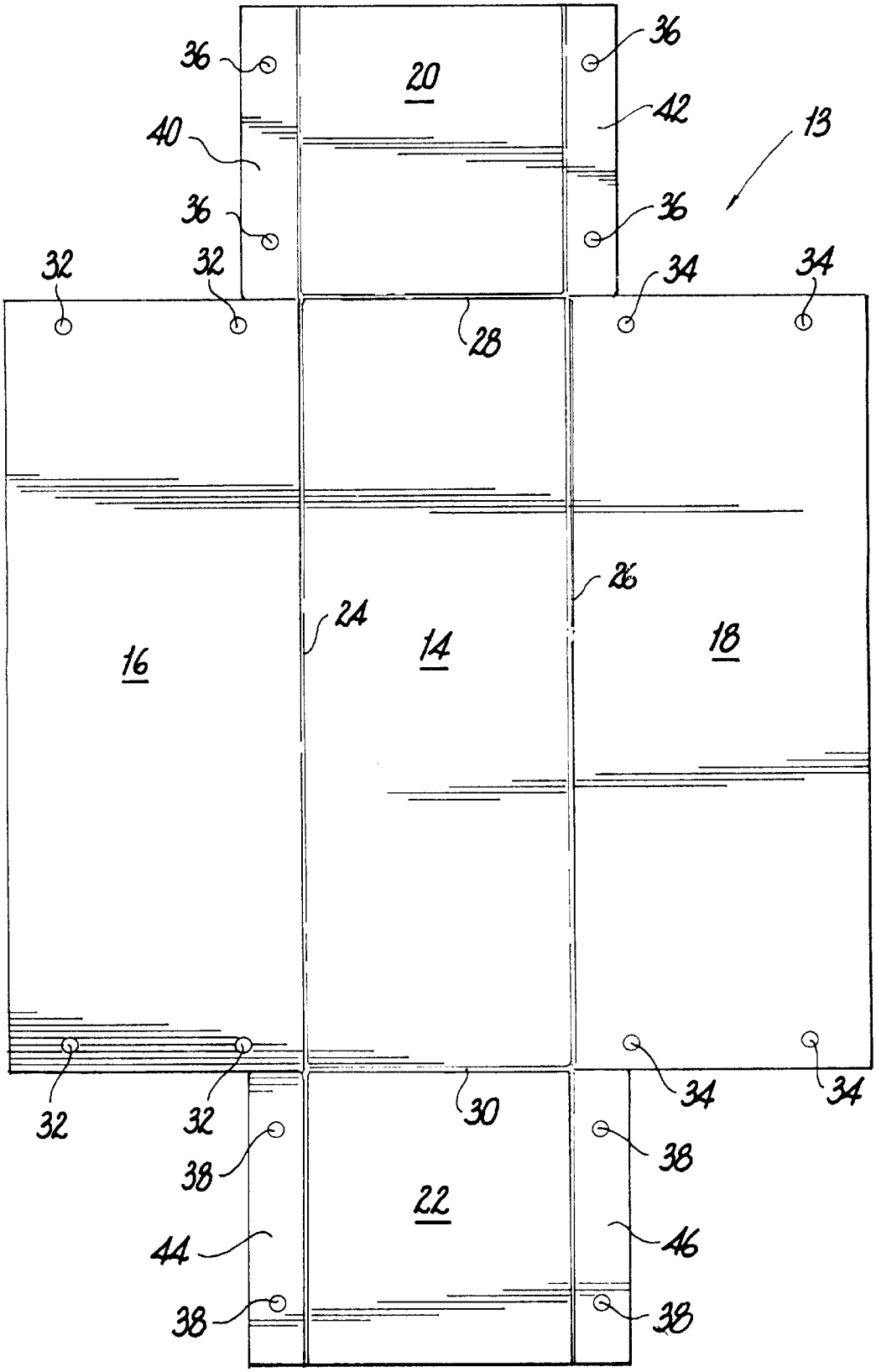
FIG. 1 is a plan view of a foldable, elongated sheet according to the present invention.

Referring to FIGS. 1–4, a container 10, according to the present invention, is illustrated. Container 10 may include an upper cover portion (which is not illustrated in FIGS. 1–4 for the sake of clarity). The container is formed from an elongated planer sheet, preferably of rigid cardboard, and has a bottom wall section 14 and four side walls sections 16, 18, 20, 22. Each of the side walls 16, 18, 20, 22 are pivotably connected to the bottom wall 14 along fold lines 24, 26, 28, 30, respectively.

Each side wall has four throughbores, such that two bores are disposed along opposite edges. Side wall 16 has four throughbores 32, side wall 18 has four throughbores 34, side wall 20 has four throughbore 36 and side wall 22 has four throughbores 38. Each side wall 20 and 22 includes a pair of flaps 40, 42 and 44, 46, respectively. Flaps 40, 42 are pivotably connected to side wall 20 along a fold line and flaps 44, 46 are pivotably connected to side wall 22 along a fold line. Two bores 36 are disposed in flap 40 and two bores 36 are disposed in flap 42. Similarly, two bores 38 are disposed in flap 44 and an additional two bores 38 are disposed in flap 46.

Figure 2:
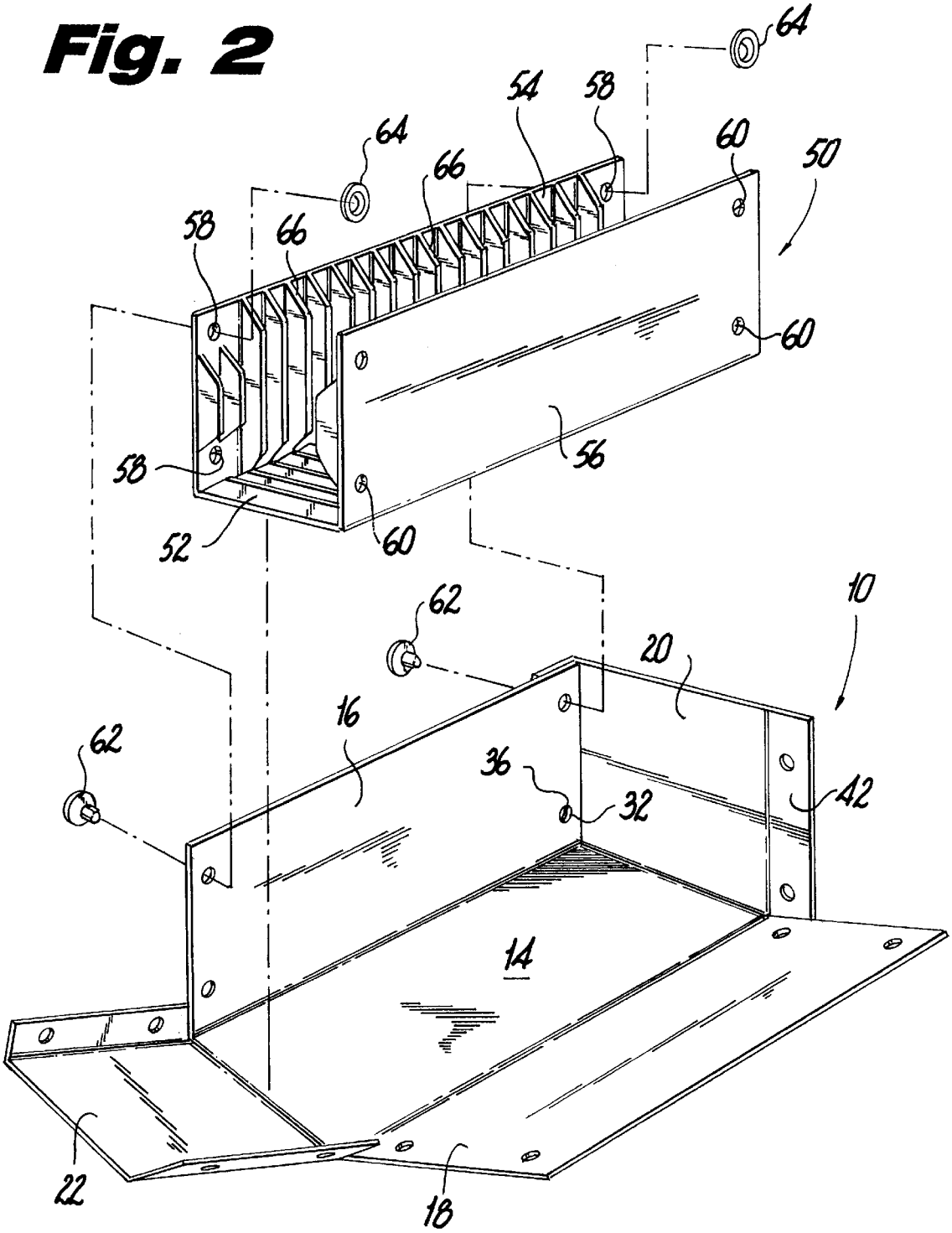
FIG. 2 is a perspective, exploded view of the elongated sheet being partially folded and an insert being folded and ready to be placed within the folded, elongated sheet.
Figure 3:
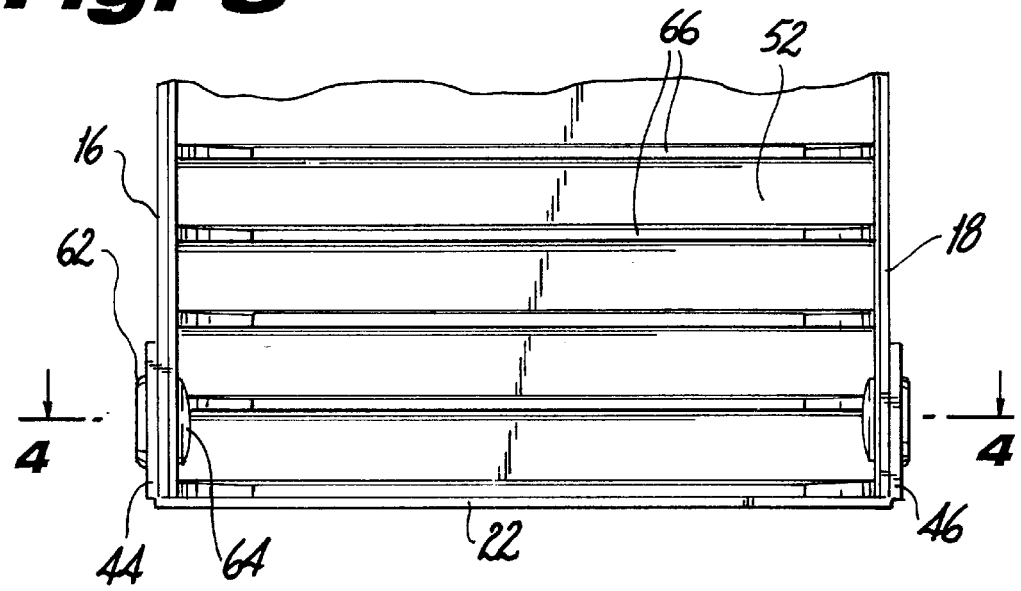
FIG. 3 is a partial plan view of the assembled container of FIG. 2.
Figure 4:
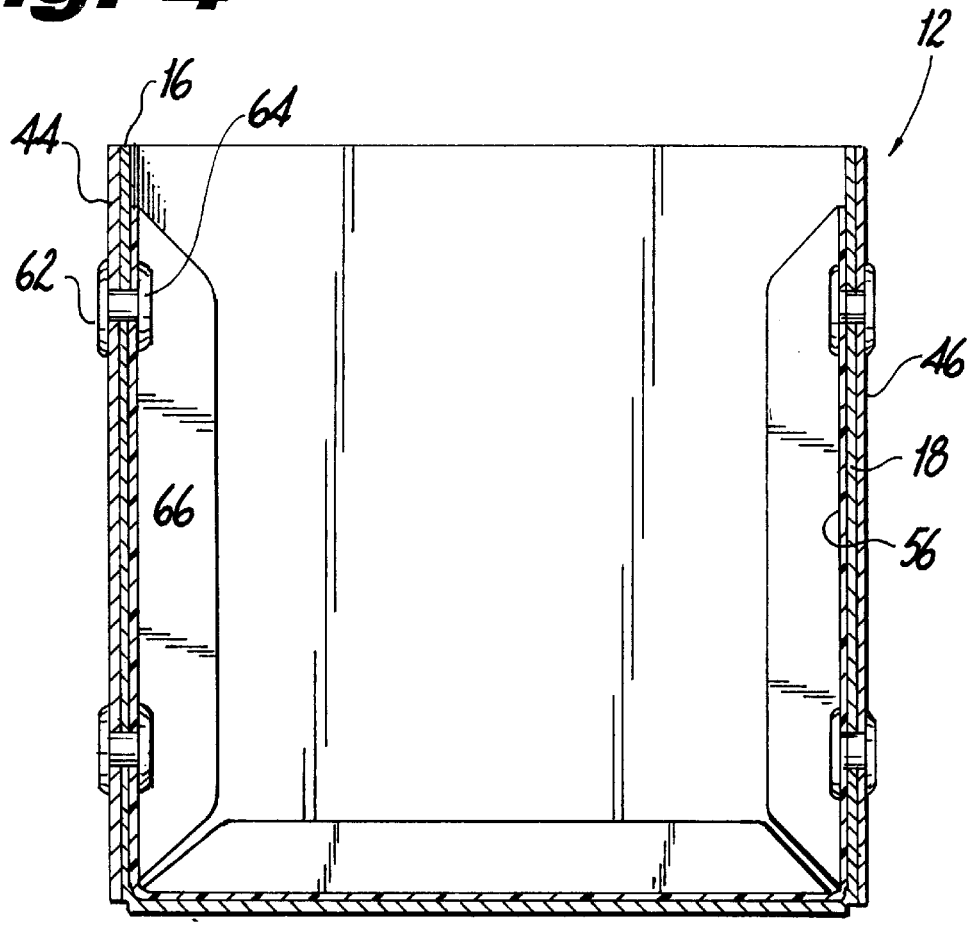
FIG. 4 is a sectional view taken along lines 4—4, FIG. 3, and looking in the direction of the arrows.

An insert 50 is formed from a bottom wall 52 and two side walls 54, 56. Each side wall 54, 56 has four throughbores 58, 60, respectively. As illustrated in FIG. 2, to form a box like shape, the side walls 16, 18, 20 and 22 are folded so that they are each disposed at a right angle with respect to bottom wall 14. One way of assembling the box is to first fold side wall 16 and then side wall 20 into an upright position as illustrated in FIG. 2. Flap 40 is then pivoted with respect to side wall 20 so that bores 36 mates with bores 32. Flap 44 is then pivoted with respect to side wall 22 so that bores 28 mate with bores 32. The insert is folded such that each of the side walls 54, 56 are disposed at a right angle with respect to the bottom wall 52. The insert is placed within the container 10 such that bores 58 of the insert mate with the mating bores 32, 36 and 32, 38 of the lower portion.

In a preferred embodiment, a fastener is comprised of two portions, a male portion 62 and a female portion 64. The fastener portions 62, 64 preferably snap together, but of course, other types of fasteners such as, for example, threaded fasteners can also be used. Four male fasteners are positioned so that one fastener extends through each of the mating bores 32, 36, 58; 32, 38, 58. The fasteners maintain the position of the box and the position of the insert within the box. The male fastener 64 is then connected to a female fastener 62 to complete the assembly of the box.

Insert 50 is connected to container 10 solely by the fastener connection. Insert 50 also includes a plurality of inwardly directed projections 66, which are preferably equally spaced from one another at a predetermined distance so as to receive, for example, a jewel box which holds a compact disc. Of course the spacing could be of other sizes to hold other objects, for example, a cassette box, mini-disc box, etc. The insert is preferably made of plastic material.

Figure 5:
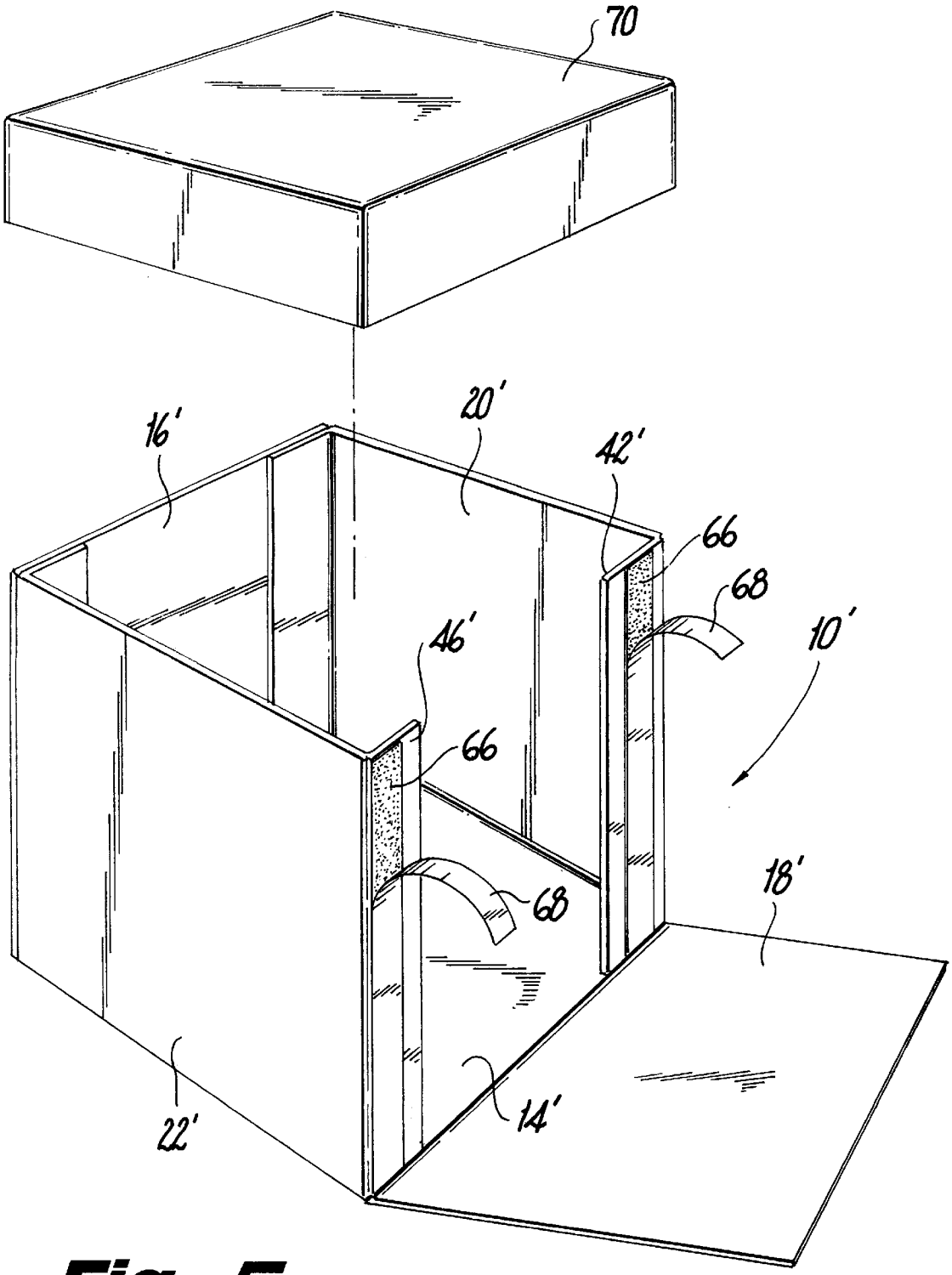
FIG. 5 is a perspective, exploded view of a second embodiment of the present invention.

A second embodiment of the container 10' in accordance with the present invention is illustrated in FIG. 5. This embodiment varies from the embodiment illustrated in FIGS. 1–4, in that the box is being shown without an insert and the flaps of the side walls 20', 22' are connected to the adjacent side walls 16', 18' by the use of a piece of two-sided adhesive tape. Two-sided adhesive tape per sé, is conventional and can be purchased from such companies as, for example, 3M. Tape 66 is covered on the outwardly facing side by a removable covering paper 68. Accordingly, to assemble the box, the user will simply fold sides 20', 22' so that they are disposed at a right angle with respect to bottom wall 14'. The covering paper 68 is then removed to expose the adhesive tape 66. Thereafter, the adjacent sides 16', 18' are placed adjacent to the flaps so that sides 16', 18' adhere to the flaps. Of course, the tape can be disposed on the inwardly facing surface of the side wall 16', 18'. Alternatively, the flaps 42', 46' could be disposed outwardly with respect to the flaps 16', 18'. Tape 66 would then be disposed on either the inwardly facing surface of flaps 42', 46' or on the outwardly facing surface of the side walls 16', 18'.

A cover 70 is illustrated in FIG. 5 and has a dimension slightly greater than a dimension of container 10' so as to fit snugly over the assembled side walls 16', 18', 20', 22'. Cover 70 can be assembled in a manner similar to either container 10 or container 10' and can be used with either embodiment of the present invention. Of course, one skilled in the art would appreciate that the dimensions of the cover will depend upon the dimensions of the assembled container.

As pointed out above, the elongated sheet forming either container 10, 10' is preferably formed from rigid cardboard. The outwardly facing surfaces of the elongated sheet may have a design printed thereon to improve the appearance of the box. The design can be such that the box can function as a gift box, which requires no further wrapping.

Having described the presently preferred exemplary embodiment for a container in accordance with the present invention, it is believed that other modifications, variations and changes will be suggested to those skilled in the art in view of the teachings set forth herein. It is, therefore, to be understood that all such modifications, variations, and changes are believed to fall within the scope of the present invention as defined by the appended claims.

I claim:

1. An apparatus comprising:

a bottom wall;

four side walls, each of said side walls being pivotably connected to said bottom wall, each of said side walls having at least one bore, said at least one bore in each of said side walls mating with said at least one bore in an adjacent one of said side walls when the apparatus is in a folded configuration;

an insert having a bottom wall and two side walls, each of the insert side walls has at least one bore that mates with at least one bore in one of said side walls, said insert includes a plurality of inwardly directed projections disposed on said insert side walls, a fastener extending through each of the mating bores in said side walls and the insert bores to maintain the shape of the apparatus in said folded configuration and to maintain the position of said insert within the folded configuration.

2. The apparatus according to claim 1, wherein said fasteners are snap-type fasteners.

3. The apparatus according to claim 2, wherein said insert is connected to the container solely by said fasteners.

4. The apparatus according to claim 1, wherein adjacent ones of said plurality of projections on the same side wall are equally spaced from one another.

5. The apparatus according to claim 4, wherein said bottom wall and four side walls are made of rigid cardboard.

6. The apparatus according to claim 5, wherein said insert is made of plastic.

7. The apparatus according to claim 1, wherein two of said side walls each includes a pair of flaps that are pivotably connected to said side wall on opposite edges.

8. The apparatus according to claim 7, wherein at least one of said bores is disposed in one of said flaps.

* * * * *